US005285577A

United States Patent [19]

Carney et al.

[11] Patent Number: 5,285,577

[45] Date of Patent: Feb. 15, 1994

[54] LETTER OPENER WITH PROTECTED RECESS FOR BUSINESS CARD AND REMOVABLE SLIDE-IN COVER

[75] Inventors: Albert P. Carney; David P. Lage, both of St. Louis County, Mo.

[73] Assignee: Quick Point, Inc., Fenton, Mo.

[21] Appl. No.: 887,086

[22] Filed: May 22, 1992

[51] Int. Cl.[5] ..... B26B 29/00

[52] U.S. Cl. ..... 30/294; 30/289; 30/DIG. 3; D8/102

[58] Field of Search ..... 30/294, 286, 289, 1, 30/2, DIG. 3; 40/642, 649, 653; D8/102, 98

[56] References Cited

U.S. PATENT DOCUMENTS

| | | | |
|---|---|---|---|
| D. 306,394 | 3/1990 | Koenig | D8/102 |
| 2,442,694 | 6/1948 | Keiser | 30/DIG. 3 |
| 2,535,555 | 12/1950 | Tilly | 30/DIG. 3 |
| 3,009,248 | 11/1961 | Tilly | 30/DIG. 3 |
| 3,028,670 | 4/1962 | Tilly | 30/DIG. 3 |
| 3,290,782 | 12/1966 | Oehlert | 30/294 |
| 4,450,955 | 5/1984 | Featherston | 40/649 |
| 4,530,154 | 7/1985 | DiCarlo | 30/DIG. 3 |

FOREIGN PATENT DOCUMENTS

| | | | |
|---|---|---|---|
| 407789 | 11/1944 | Italy | 30/294 |

OTHER PUBLICATIONS

Quick Point catalog, 1990, pp. 52 and 53, "Envelope Opener".

Quick Point promotional sheet entitled Home Opener.

*Primary Examiner*—Douglas D. Watts

*Assistant Examiner*—Hwei-Siu Payer

*Attorney, Agent, or Firm*—Polster, Lieder, Woodruff & Lucchesi

[57] ABSTRACT

A business card letter opener having printed indicia on one surface and a recess in the opposite surface sized to accomodate a business card and covered by a transparent cover lens which slides over the recess and is snap locked into place over the recess to protect the card and allow it to be viewed through the cover lens.

6 Claims, 1 Drawing Sheet

PYA

LETTER OPENER WITH PROTECTED RECESS FOR BUSINESS CARD AND REMOVABLE SLIDE-IN COVER

BACKGROUND OF THE INVENTION

This invention relates to letter openers and in particular to letter openers having a razor type slitter with a portion of the body being available for indicia, such as advertising, or the like. This invention has a removable slide-in front cover member adapted to enclose a recess in the body in which business cards, calling cards or the like can be located and protected. The back of the body may be opaque so that printed indicia can be placed thereon. These and other objects and advantages of the invention will be seen from the drawings and description set forth hereinafter.

The present invention comprises a letter opener in which the main body is provided with a recess adapted to retain a business card and a removable slide-in cover adapted to be snapped in place to cover and enclose the card positioned within the recess. The opener also has advertising space on the back side for printed indicia or the like.

The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figures 1, 2, 3, 4, 5, 6:
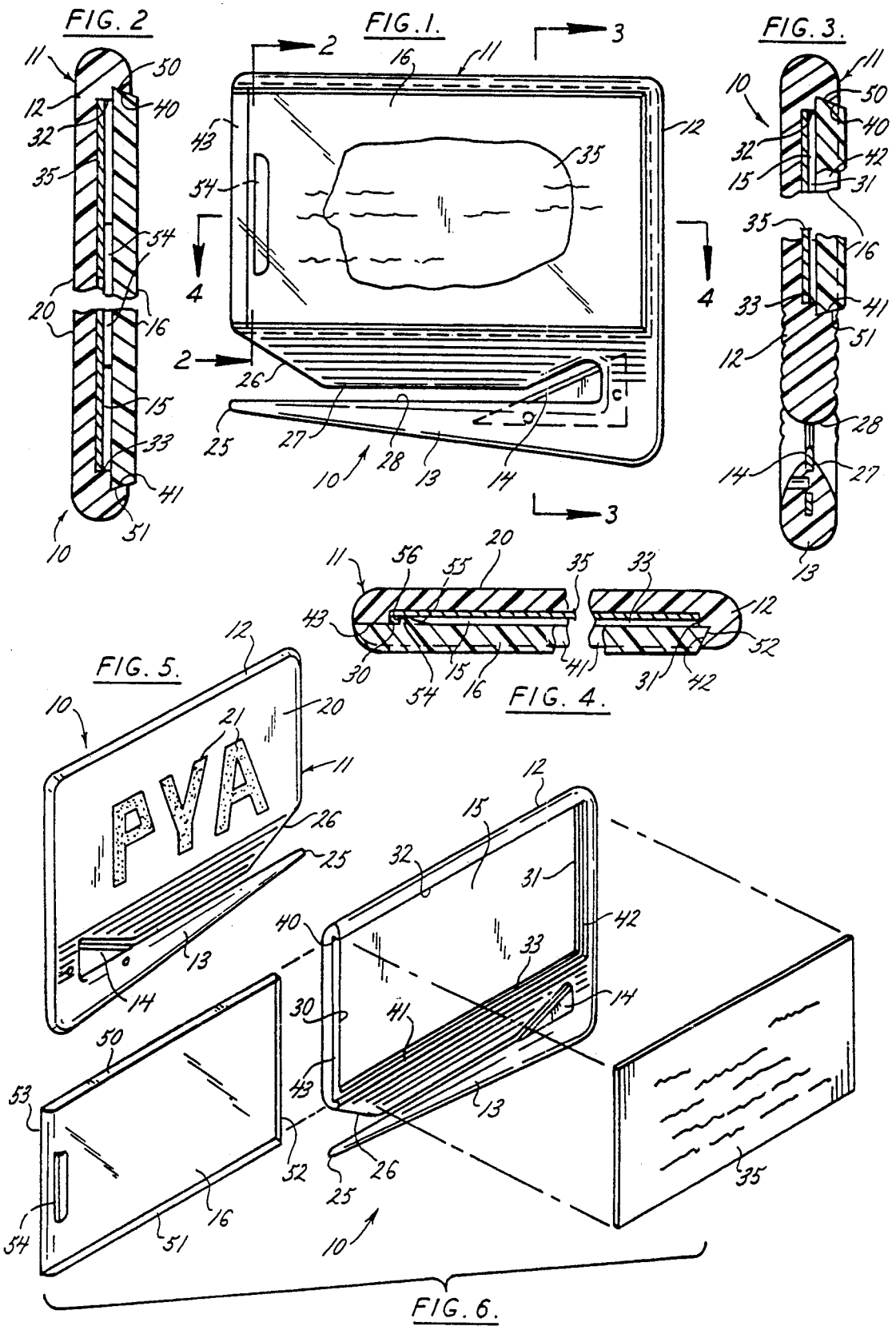
FIG. 1 is a plan view of the invention.
FIG. 2 is a sectional view of the invention taken along line 2—2 of FIG. 1.
FIG. 3 is a sectional view taken along line 3—3 of FIG. 1.
FIG. 4 is a sectional view taken along line 4—4 of FIG. 1.
FIG. 5 is a perspective view of the letter opener.
FIG. 6 is an exploded view showing the assembly of the various parts.

FIG. 1 shows a letter opener 10. The letter opener 10 includes a main body 11 which comprises a first generally rectangular shaped member 12, a second finger shaped member 13, which generally parallels one side of the first member 12, and a cutting edge 14, located at juncture of the first member 12 and the second member 13. The cutter 14 is embedded in the first and second members. The first member 12 has a recess 15 formed in the front side thereof (FIG. 3) and the recess 15 is enclosed by a transparent slide-in cover member 16 adapted to be locked in place over the recess 15. This is shown more clearly in FIG. 4.

The main body 11 is a unitary molded part which preferably is made from opaque polymeric material. The back outer face 20 can have advertising indicia 21 printed thereon.

The finger shaped member 13 is provided with a sharpened point 25 to facilitate insertion between the main body of an envelope and the glue flap. The main body first member 12 has a tapered guide-in surface 26 to facilitate insertion of the tip 25 into the hinge of the envelope glue flap and to guide the envelope into the channel defined by the internal surfaces 27 and 28 of the first member 12 and the finger member 13, respectively, whereby engagement of the envelope and the letter opener 10 is facilitated so that the envelope is fed to the knife edge 14.

The recess 15 is substantially rectangular in shape and is defined by the end walls 30, 31 and longitudinal side walls 32, 33. The recess 15 is sized to receive a standard sized business card 35.

Above the recess 15 are under-cut longitudinal channels 40, 41 and an undercut end channel 42 defined by the broken lines in FIG. 1.

The front end of the recess 15 is open at 43 where the channels 40, 41 terminate. This allows the cover 16 to be slid through the open end 43 into the channels 40, 41.

The cover member 16 is substantially rectangular in shape and has substantially coextensive edges which mate with the recess channels 40, 41 and 42 and the recess open end 43.

In particular, the cover member 16 has tapered side edges 50 and 51 which are inclined outwardly (FIGS. 2, 3, 6) to cooperate with the recess side edges 40 and 41, and a tapered front edge 52 adapted to engage the recess front edge 42 (FIG. 4).

At its rear end 53, the cover 16 has an internal lock means 54. The lock means 54 has a tapered bottom edge 55 and a lock shoulder 56, which is adapted to lockingly engage the recess back edge 30. The inclined edge 55 allows the cover 16 to glide over the back edge 30 as the cover 16 is placed over the recess 15. Other types of snap-in or lock-in features can be used in place of the lock shoulder 56.

Thus once the card 35 is positioned in the recess 15, the cover 16 is slid into the opening defined by the recessed side edges 40, 41 and 42, and when it is fully positioned over the recess 15, it is pushed inwardly and the lip 56 is locked behind the recess back edge 30.

This invention is intended to cover all changes and modifications of the example of the invention herein chosen for purposes of the disclosure which do not constitute departures from the spirit and scope of the invention.

What is claimed is:

1. A calling card letter opener comprising:

(a) a main body having a first member having a front face and a rear face, said front face being provided with a substantially rectangular recess sized to accept a calling card, said recess having side and front edges and an open back edge, and a second finger shaped member connected to the first member at one end and extending generally parallel to and spaced from the first member, the juncture of the first and second members defining a loop shaped corner;

(b) a cutting edge embedded in the first and second members at their juncture and extending into and exposed at the corner there between;

(c) a removable substantially rectangular slide-in transparent cover member adapted to enclose the recess in the first member and retain and protect a calling card located therein, and permit it to be viewed there through, the cover member being slidable into the recess from the said substantially open edge; and (d) means associated with the cover member and the recess to permit the cover to be slid over the recess from the open edge and locked in place.

2. A calling card letter opener comprising:

(a) a main body having a first member having a front face and a rear face, said front face being provided with a recess having an open end and being sized to accept a calling card, and a second finger shaped member connected to the first member at one end and extending generally parallel to and spaced from the first member, the juncture of the first and second members defining a loop shaped corner;

(b) a cutting edge embedded in the first and second members at their juncture and extending into and exposed at the corner there between;

(c) a removable slide-in transparent cover member adapted to enclose the recess in the first member and retain and protect a calling card located therein, and permit it to be viewed there through, the cover member being slidable into the recess from the said substantially open edge; and (d) wherein the recess in the first member is substantially rectangular in shape with undercut side and front edges, and an open back edge, and the cover member is substantially rectangular in shape and has side edges shaped to cooperate with the recess side edges, a front edge shaped to engage the recess front edge, and an internal lip adapted to lockingly engage the back edge of the recess.

3. The letter opener of claim 2 wherein the first member is opaque and includes printed indicia on the rear face.

4. The letter opener of claim 2 wherein the finger shaped member is tapered to a pointed end which is insertable between the body and flap of a sealed envelope to facilitate opening the envelope.

5. The letter opener of claim 2 wherein the internal lip has a tapered front to facilitate moving the cover over the recess and a square shoulder to lock the cover in place over the recess.

6. A business card letter opener comprising:

(A) a main body comprising 1. a first member having opposed parallel longitudinal edges and opposed parallel lateral edges, and provided with a recess to receive and retain a business card,
2. a second finger shaped member connected to the first member at one of the lateral edges and extending generally parallel to and spaced from one of the longitudinal edges,
3. the juncture of the first and second members defining a cul-de-sac,
4. the recess in the first member having
   (a) a bottom sized to receive a business card,
   (b) longitudinal and lateral side walls surrounding the bottom,
   (c) a set of longitudinal undercut channels adjacent to the longitudinal side walls,
   (d) an inclined transverse channel adjacent to one of said lateral side walls and extending between the longitudinal channels at one end thereof to define an inclined stop,
   (e) a flat surface defining the top of the other of said lateral side walls, (B) a removable transparent snap-in cover adapted to slide onto the first member and having a leading and opposed lateral edges and opposed longitudinal edges, 1. the longitudinal edges being tapered to match the longitudinal undercut channels to thereby retain the cover on the first member,
2. the leading lateral edge having an inclined surface to matingly engage the inclined stop,
3. a downwardly extending lip on the undersurface of the cover adjacent to the opposite lateral edge adapted to slide over the flat surface of the other lateral side wall opposite to the stop, said lip having an inclined front edge to facilitate sliding over the said other lateral side wall and a straight rear edge to engage the said other lateral side wall and resist withdrawal of the cover from the top of the recess, and (C) a cutting edge embedded in the first and second members at their juncture and extending into and exposed in the cul-de-sac.

* * * * *